US006413104B1

(12) United States Patent
Bernardini

(10) Patent No.: US 6,413,104 B1
(45) Date of Patent: Jul. 2, 2002

(54) POWER DISTRIBUTION PANEL WITH SEQUENCE CONTROL AND ENHANCED LOCKOUT CAPABILITY

(75) Inventor: Allen J. Bernardini, Southbury, CT (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/492,817

(22) Filed: Jan. 28, 2000

(51) Int. Cl.[7] ..... H01R 13/44

(52) U.S. Cl. ..... 439/133; 439/924.2; 439/304; 70/57

(58) Field of Search ..... 439/133, 142, 439/299, 924.1, 924.2, 345, 347, 304; 70/57, 58, 163, 166, 170, 179

(56) References Cited

U.S. PATENT DOCUMENTS 3,994,148 A * 11/1976 Anderson
4,034,172 A * 7/1977 Glover et al.
4,080,029 A * 3/1978 St. Fort
4,093,331 A * 6/1978 Molchan
4,146,682 A * 3/1979 Nakao ..... 429/97
4,740,168 A * 4/1988 Carney et al. ..... 439/133
4,941,841 A * 7/1990 Darden ..... 439/374
4,955,821 A 9/1990 Bernardini ..... 439/133
5,113,311 A * 5/1992 Kamp et al. ..... 439/133
5,429,522 A * 7/1995 Noschese et al. ..... 439/133
5,488,208 A * 1/1996 Seewald ..... 439/133
5,934,918 A * 8/1999 Wuechner ..... 439/133

OTHER PUBLICATIONS

Litton/VEAM, "Electrical Power Distribution Solutions", Litton Systems, Inc., 1997, pp. 1–11.

* cited by examiner

*Primary Examiner*—Neil Abrams
(74) *Attorney, Agent, or Firm*—Lowe Hauptman Gilman & Berner, LLP

(57) ABSTRACT

A locking cover plate and locking device respectively, control access to a receptacle and inhibit removal of a plug from a receptacle of a power distribution panel having a sequential coupling guard at a row of receptacles. The first locking cover plate rotates to lock and unlock a receptacle by covering the receptacle using a cover plate portion and uncovering the cover plate portion from the receptacle, respectively. The locking device rotates to lock and unlock a plug in the last receptacle by inhibiting removal of the plug from the receptacle using a tab portion and allowing removal of the plug by rotating the tab portion, respectively.

9 Claims, 9 Drawing Sheets

POWER DISTRIBUTION PANEL WITH SEQUENCE CONTROL AND ENHANCED LOCKOUT CAPABILITY

FIELD OF INVENTION

The present invention relates generally to a method of and apparatus for locking an electrical plug to a power distribution panel having a sequential coupling guard and precluding removal of an electrical plug from such power distribution panel.

BACKGROUND ART

Power distribution panels employing sequential coupling guards are known in the art. An example is disclosed in U.S. Pat. No. 4,955,821 (hereinafter the '821 patent) entitled "Method For Controlling Connector Insertion Or Extraction Sequence On Power Distribution Panel" to the present inventor and assigned to a common assignee which is hereby incorporated by reference in its entirety into this specification.

FIGS. 1–5 are taken from the '821 patent and represent the prior art. With reference to FIG. 1, there is shown a cam ring mechanism including a plurality of cam rings 11–15 mounted in an upper and lower channel member 20 and arranged along a common axis 30 best seen in FIG. 2 which passes through the three and nine o'clock positions of each of the rings. The cam rings 11–15 are positioned at the rear of an array of electrical receptacles 21–25: the receptacle 21 may be a ground receptacle, the receptacle 22 may be a neutral receptacle, and the receptacles 23–25 may be for three-phase power. The receptacles are the type in which a plug must be twisted or rotated approximately 45° before making a final electrical connection thereto.

Each cam ring 11–15 includes an outer cam surface 16 which is generally convex in shape. The cam surface 16 does not extend completely around the cam ring and is subtended by a clearance notch 17 and a locking notch 18. The clearance notch 17 and the locking notch 18 are generally concave in shape and are dimensioned to mate with the convex cam surface 16 on an adjacent cam ring. The clearance notch 17 is located between the one and two o'clock position on each cam ring and the locking notch 18 is located at the nine o'clock position. Each cam ring includes a pair of tabs 19 which extend toward the center portion of the ring and provide engagement means for turning the cam ring as more fully described below. Rotation of each cam ring is limited by stops 27.

In FIG. 1, each of the rings 11–15 is in an original, unrotated position. In FIG. 2, the first three rings 11–13 have been rotated clockwise as if an electrical connection has been made to the first three receptacles 21–23. The plugs inserted in the receptacles are not shown.

FIG. 3 shows an alternate embodiment of the invention in which each of the receptacles 22–25 is positioned behind an aperture 28 in a front panel 29 and access to the apertures 28 is controlled by a cover plate 32–35, respectively. Each of the cover plates 32–35 is mechanically coupled to the cam ring adjacent and to the left of the receptacles 22–25; that is, cover 32 is coupled to the cam ring 11, cover 33 is connected to the cam ring 12, cover 34 is connected to the cam ring 13, and cover 35 is connected to the cam ring 14. The connection between the cam rings and the various covers 32–35 is made by a link 37 best seen in FIGS. 4 and 5. It will be noted that there is no cover plate over the first receptacle 21. This is problematic as will be described below.

FIG. 4 shows a side view of the receptacle assembly 21 which comprises a conductive pin 41 and an insulating sleeve 42 which is spaced therefrom. The cover plate 32 which in one position blocks access to the adjacent receptacle 22 is shown rotated to an open position and is connected to the cam ring 11 by the link 37. The conductive pin 41 and the sleeve 42 are mounted on a support 43 and a coupling tab 44 extends from the rear of the pin 41 for connection to a cable or other conductive element as well known in the art.

A plug 46 comprises an electrical socket 47 and an insulating sheath 48 which are dimensioned to mate with the receptacle 21. The conductive socket 47 is coupled to a cable connector 50 which may be terminated to an electrical cable as well as known in the art. The forward portion of the insulating sheath 48 includes a pair of slots 49 which are dimensioned to receive the radially extending tabs 19 on the cam ring. The forward portion of the socket 47 includes two L-shaped slots 51 best seen in FIG. 5 which receive two oppositely directed locking pegs 52 on the rear portion of the pin 41. When the socket 47 is fully engaged with the pin 41, the locking pegs 52 are at the bottom of the respective L slots 51; and the socket 47 may be rotated clockwise to position each of the locking pegs 52 in the foot 53 of the respective slot 51 to lock the socket onto the pin 41. Rotation of the socket also rotates the cam ring through the engagement of the tabs 19 in the slots 49. The rotation of the cam ring is limited by the abutment of the tabs 19 against the stops 27.

Mode Of Operation

The coupling guard controls the sequence of connecting a plurality of plugs to a plurality of receptacles as explained below.

Referring first to FIG. 1, the cam ring 11 which surrounds the ground receptacle 21, may turn either clockwise or counterclockwise since the cam surface 16 is free to turn relative to the locking notch 18 on the cam ring 12. The cam ring 12 is not free to turn, however, since the locking notch 18 is in an abutting relationship with the cam surface 16 of the cam ring 11. In a similar way, the locking notch 18 of each of the cam rings 13–15 is in abutting relationship with the cam surface 16 of the cam ring to the immediate left. Rotating the cam ring 11 clockwise approximately 45° will abut the tabs 19 against the stops 27 and will position the clearance notch 17 of the cam ring 11 adjacent the cam ring 12. in this position, the cam ring 12 is free to rotate since the cam surface 16 of the ring 12 will pass through the clearance notch 17 of the cam ring 11. After the cam ring 12 has been rotated clockwise approximately 45°, the clearance notch 17 of cam ring 12 will be adjacent the cam ring 13. This will allow the cam ring 13 to be rotated; and in a similar fashion, the cam rings 14 and 15 may likewise be rotated once the cam ring immediately adjacent and to the left has been rotated clockwise to position the clearance notch 17 adjacent the cam ring which is next to be rotated.

In the manner described above, a series of plugs which must be rotated to couple with a series of receptacles can only be connected to the receptacles 21–25 in sequence from left to right. Engagement means on the cam rings such as the tabs 19 may be used to interlock with a plug which is inserted into the receptacle and to turn in response to a rotation of the plug. The clockwise rotation of the plug and the cam ring allows the adjacent cam ring to the right to be turned and thus the sequence of connections to be made. Plug and receptacle connectors such as shown in FIGS. 4 and 5 which require a partial turn or twist in order to make final electrical connection to a receptacle are well known in the art. Such connectors can be used with the apparatus of FIG. 1 with the result that the several plugs will have to be coupled to the plural receptacles in the predetermined sequence.

The apparatus of FIG. 1 will also insure that the disconnection of the several plugs is made in the correct sequence. As shown in FIG. 2, once the cam rings 12 and 13 have been rotated 45° clockwise, the cam surface 16 of the cam rings 12 and 13 engages the clearance notch 17 of the cam rings 11 and 12, respectively. As a result, the cam rings 11 and 12 are locked against rotation; and cam ring 13 must be rotated counterclockwise to align the locking notch 18 of the cam ring 13 with the cam ring 12. Once this alignment has been made, it will be possible to rotate the cam ring 12 counterclockwise to align the locking notch of the ring 12 with the cam ring 11. Thus, the rings as shown in FIG. 2 may be rotated 45° clockwise one at a time starting with the ring 13 in order to disengage the peg and L-slot lock and release the plugs from the receptacles 23, 22, and 21. If plugs have been connected to all five receptacles, the plugs coupled to the three power receptacles 23, 24, and 25 must be disconnected before the plug coupled to the neutral receptacle 22 or the plug coupled to the ground receptacle 21 can be disconnected.

In a further embodiment of the invention, the cover plates as shown in FIGS. 3 and 4 are used to block access to the receptacles in order to further insure that the connections are made to the receptacles in the proper sequence. As shown in FIG. 3, the receptacles 23–25 are located behind apertures 28 in the front panel 29 which may be blocked by the cover plates 33–35. The cover plates are attached by a link 37 to the cam ring immediately to the left of the receptacle over which the cover plate is located. The cover plate 32 for receptacle 22 has been rotated out of the way by rotating the cam ring 11 clockwise. As shown in conjunction with FIG. 4, slots 49 may be provided in the sheath 48 around the socket 47 to engage the tabs 19 and turn the cam ring 11. Once the receptacle 22 has been uncovered, as shown in FIG. 3, a plug may be inserted into the receptacle 22 and the plug turned clockwise to slide the cover plate 33 away from the receptacle 23. The complete connection to the five receptacles 21–25 may be made using the same sequence always rotating a cam ring to the left of a receptacle in order to slide the cover plate away from that receptacle. Once a connection has been made to any or all of the receptacles in a proper sequence, the reverse sequence must be used to disconnect the plugs as more fully explained above. Although panels having five receptacles have been shown in the various embodiments, the invention is equally applicable to panels having other numbers of receptacles. The invention is also applicable to installations in which the receptacles comprise socket connectors, and the plugs comprise pin connectors.

One problem associated with such panels is that any unblocked receptacles (unblocked by either a plug or a cover plate) are subject to misuse or vandalism. Specifically, since the power panel may be used in theater, carnival or amusement park locations where the general public may have access to the receptacles, there is a possibility that individuals will attempt to tamper with the receptacle openings. Unblocked receptacles present appealing targets to children or pranksters. Gum or debris may be inserted to block and hinder the insertion of plugs by malicious individuals or metal items might be inserted causing severe injury to the individual or damage to the equipment.

FIG. 6 depicts an improved version of the prior art power distribution panel including a lever 60 located exterior to the power distribution panel and operable with a first cover plate 62. As depicted in FIG. 6, the first cover plate 62 covers the first receptacle 21. The improvement overcomes the vulnerability of the first unblocked receptacle by using the additional cover plate 62 to cover the receptacle when no plug is inserted into the first receptacle 21. The cover plate 62 differs from the other cover plates 32–35 because the added cover plate 62 for receptacle 21 operates separately from operation of any of the receptacles 21–25. Because receptacle 21 is the first receptacle, there is no prior adjacent receptacle to rotate the cover plate 62.

In contrast to cover plates 32–35, the additional cover plate 62 is manually operated through the use of the lever 60 for opening and closing the cover plate 62 over the receptacle instead of relying on the rotation of the prior adjacent receptacle. A push button or other mechanism could be used to move the cover plate 62 from covering receptacle 21. In particular, even though the first receptacle may be protected by a lever actuated cover plate, the receptacle remains vulnerable to the same tampering, vandalism, and misuse problems. The cover plate 62 can be manually operated by anyone having access to the power panel, thus, the problems described above still apply. Gum, debris and other items may be inserted in the receptacle once the cover plate 62 has been moved out of position. Therefore, there is a need in the art to reduce the likelihood of uncovering the receptacles of a power distribution panel employing sequential coupling guards with cover plates.

Another problem associated with such panels is the removal of plugs from receptacles. Uncoupling plugs from receptacles while under load can result in injury to the operator or damage to equipment. As described above in relation to the first unblocked receptacle, power distribution panels are used in many public locations. For instance, the panel might be supplying power to a ride at a carnival where removing power while the ride is in motion would result in leaving guests suspended in midair, upside down or worse. In other situations, power might be removed in the middle of a play or concert at a theater. The same temptation to tamper with the first receptacle applies to the plugs and opening of the last receptacle. If all plugs are inserted in the corresponding receptacles, the sequential coupling guard locks in place only the plugs prior to the last plug, the guard does not lock the last plug in the receptacle. Removal of the last plug subjects both the plug and receptacle to misuse and/or vandalism. In addition, if the last plug is removed, each of the prior plugs locked in place by the subsequent plugs become removable in reverse insertion order and the plugs and corresponding receptacles are subject to tampering and uncoupling. Therefore, there is a need in the art to reduce the likelihood of removal of the last plug of a power distribution panel employing sequential coupling guards.

SUMMARY OF THE INVENTION

Accordingly, an object of the present invention is to reduce the likelihood of uncovering the receptacles of power distribution panels.

It is another object of the present invention to reduce the likelihood of removal of plugs from receptacles of power distribution panels.

The present invention is an apparatus for locking a power distribution panel. The power distribution panel has one or more receptacles for receiving one or more plugs with one or more of the plugs and corresponding receptacles being vulnerable to misuse and removal. To reduce the likelihood of misuse prior to plug insertion, a locking cover plate is mounted in the power distribution panel for controlling access to a receptacle. To reduce the likelihood of misuse and/or removal subsequent to plug insertion, a locking device is associated with the power distribution panel for locking in place a plug in a receptacle.

Another aspect of the invention relates to a method of locking a power distribution panel. The power distribution panel has one or more receptacles for receiving one or more plugs with one or more of the plugs and corresponding receptacles being vulnerable to misuse and removal. A locking cover plate is mounted in the power distribution panel for controlling access to a receptacle. A locking device is associated with the power distribution panel for locking in place a plug in a receptacle. The method comprises the steps of unlocking the locking cover plate covering the receptacle, sequentially inserting and rotating plugs in receptacles causing opening of subsequent receptacle cover plates, inserting the last plug in the last receptacle, and locking the locking device retaining the last plug in the last receptacle.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWING

The present invention is illustrated by way of example, and not by limitation, in the figures of the accompanying drawings, wherein elements having the same reference numeral designations represent like elements throughout and wherein.

DETAILED DESCRIPTION OF THE DRAWING

Figure 1:
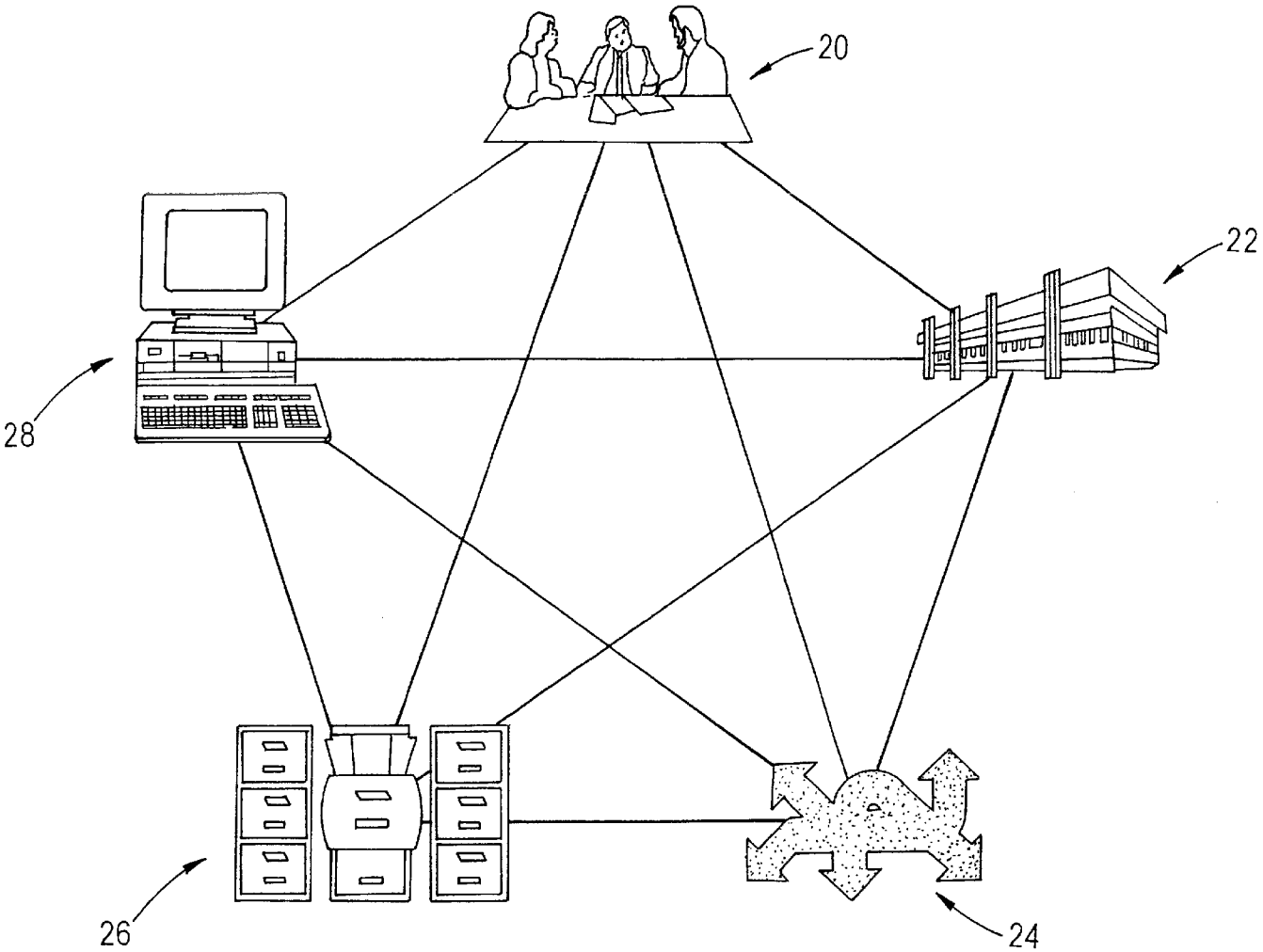
FIG. 1 is a perspective view of a plurality of cam rings and receptacles of the prior art.
Figure 2:
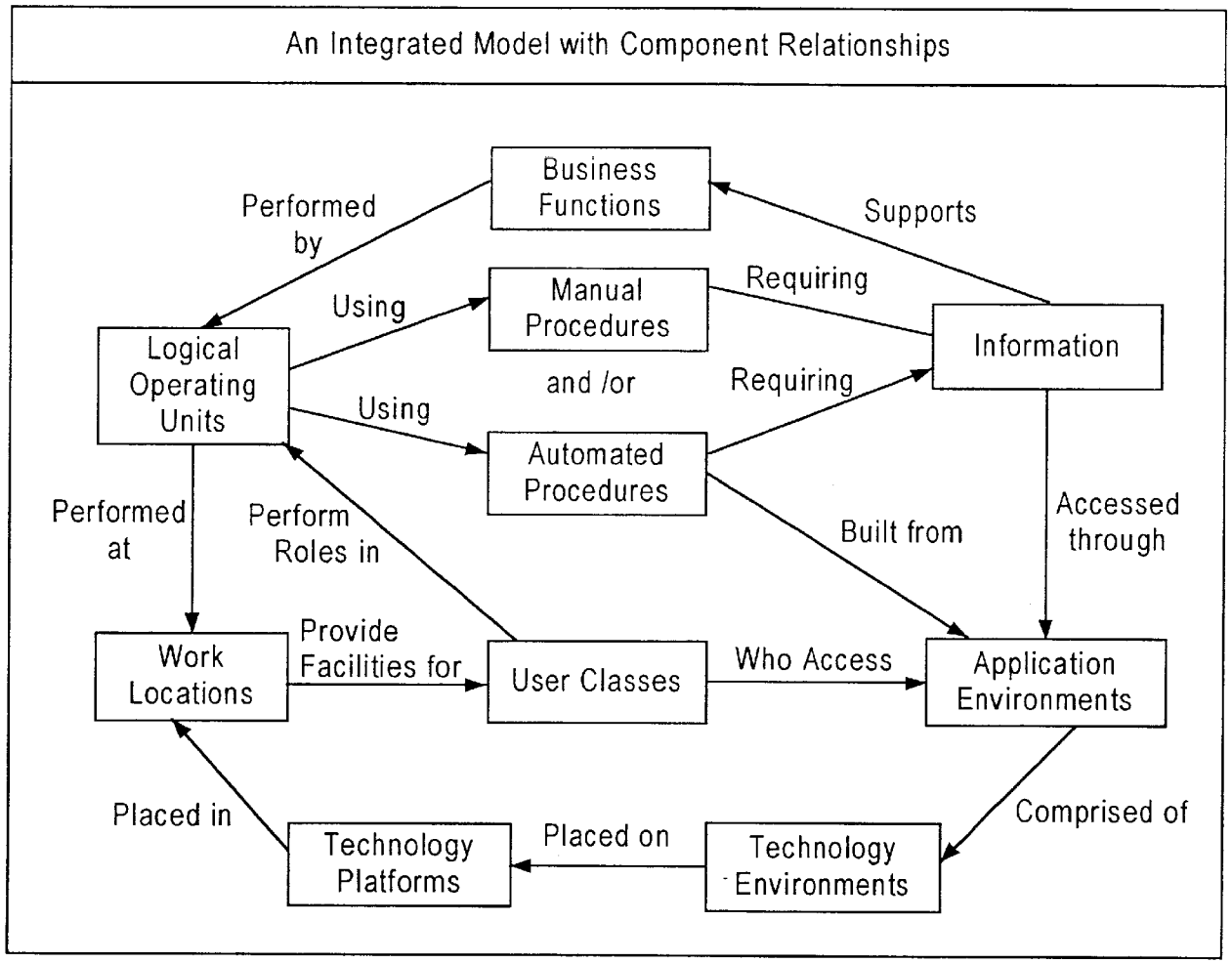
FIG. 2 (PRIOR ART)
FIG. 2 is a front view of the plurality of cam rings of FIG. 1 after rotation of some of the rings.
Figure 3:
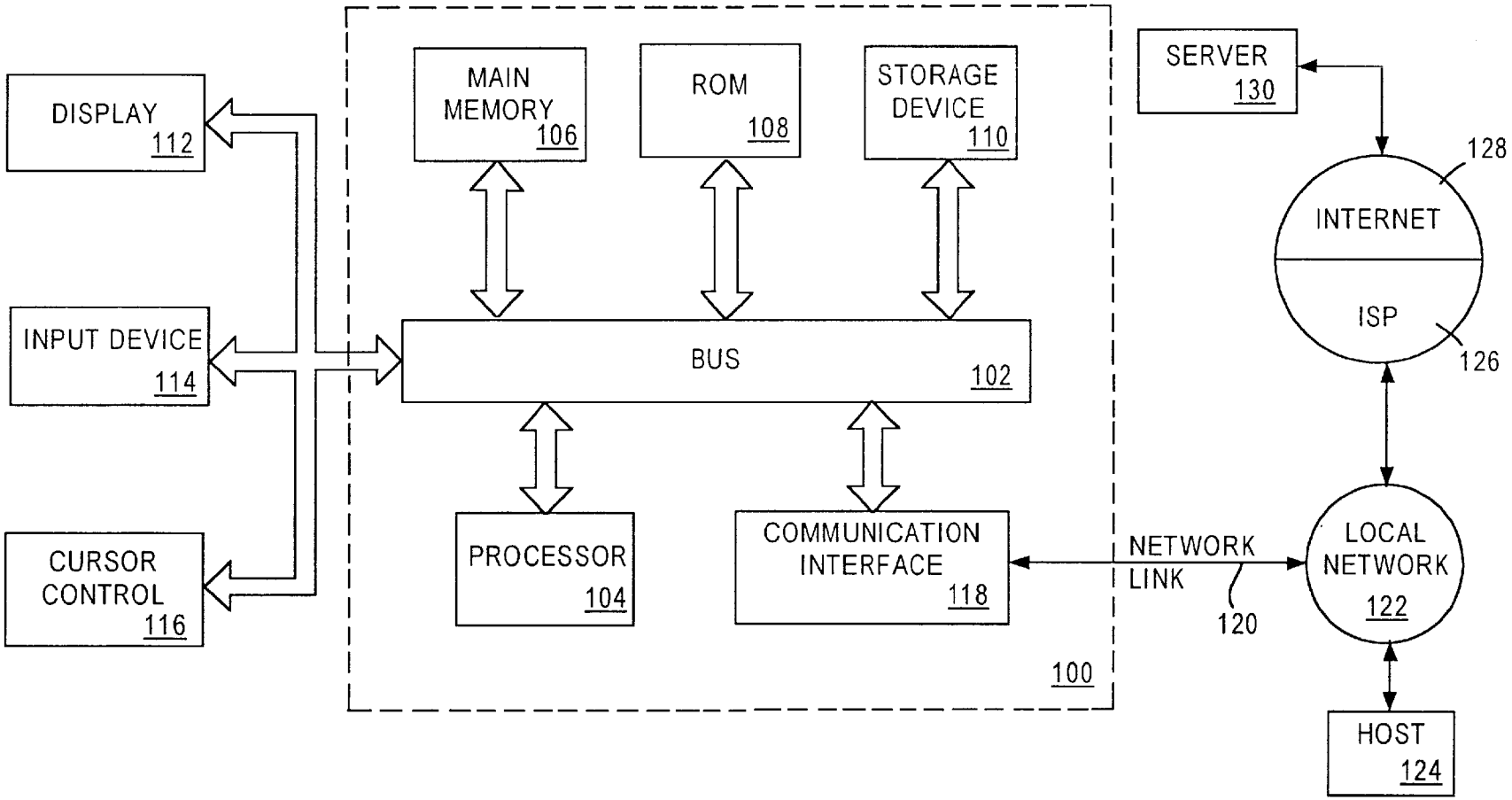
FIG. 3 is a partial front view of an alternate embodiment of the prior art including cover plates which are connected to the cam rings.
Figure 4:
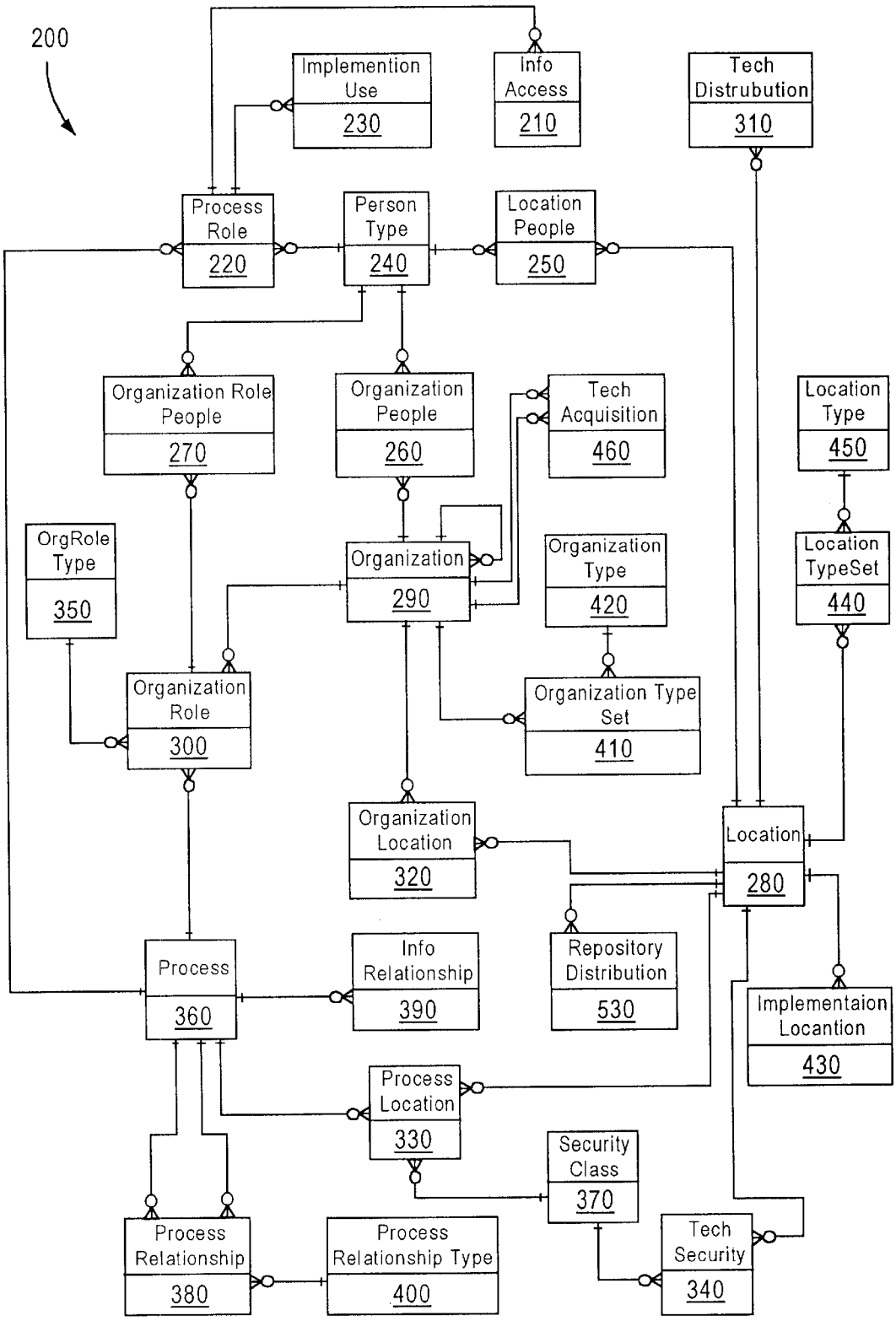
FIG. 4 is a side view of a prior art receptacle with a plug attached thereto.
Figure 5:
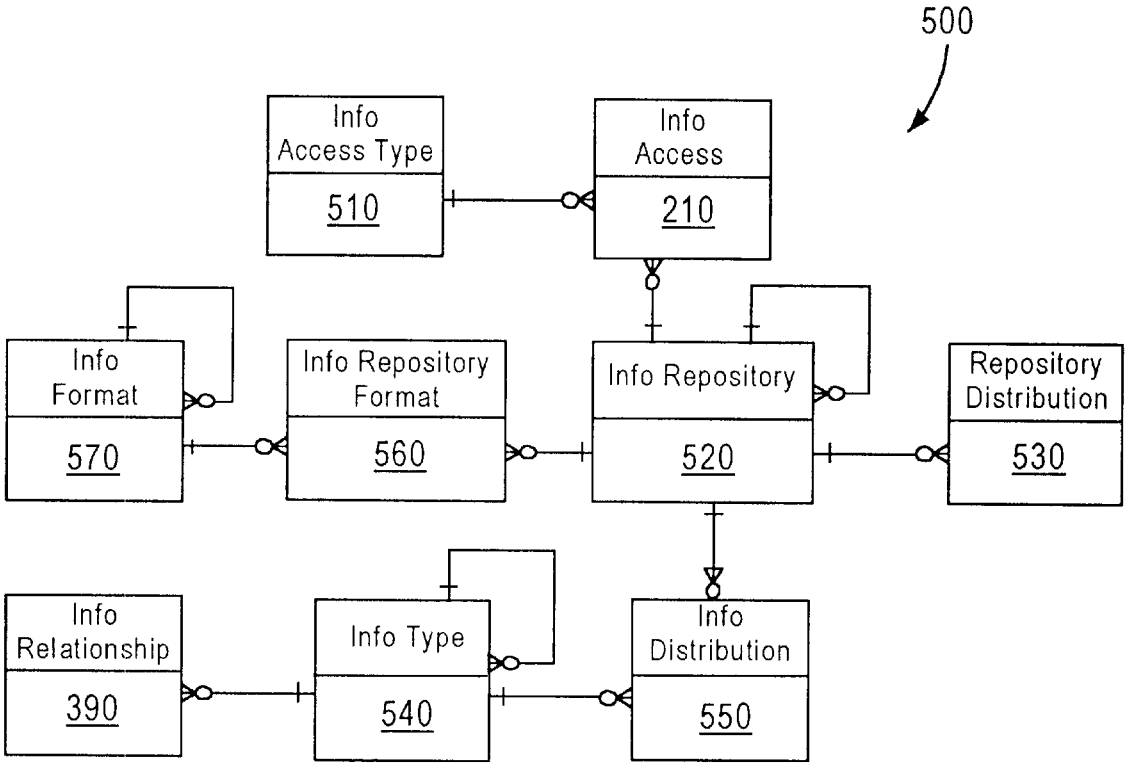
FIG. 5 is an exploded perspective view of a prior art locking mechanism for a pin and socket connector.
Figure 6:
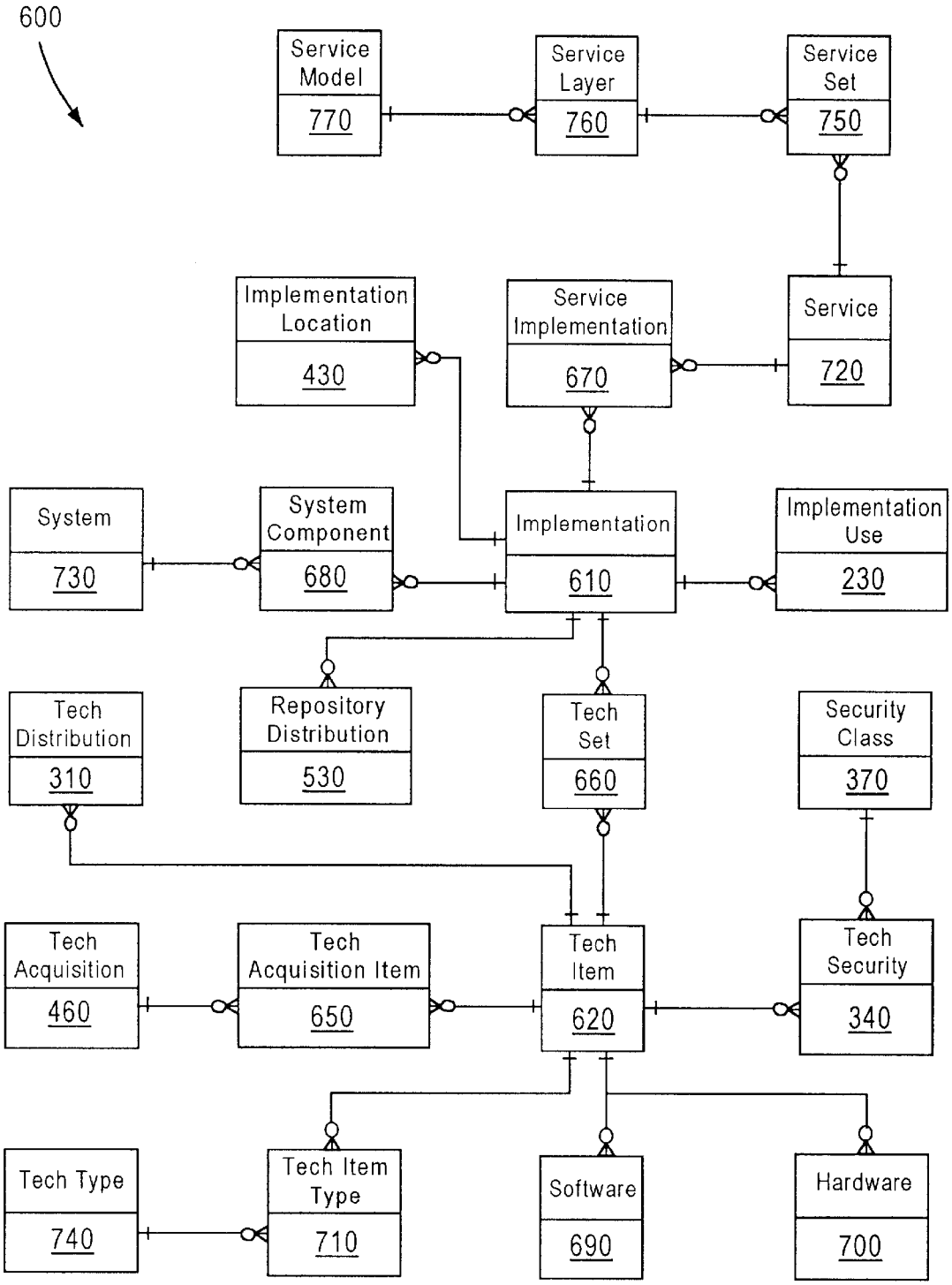
FIG. 6 is a perspective view of a detail portion of the prior art.
Figure 7:
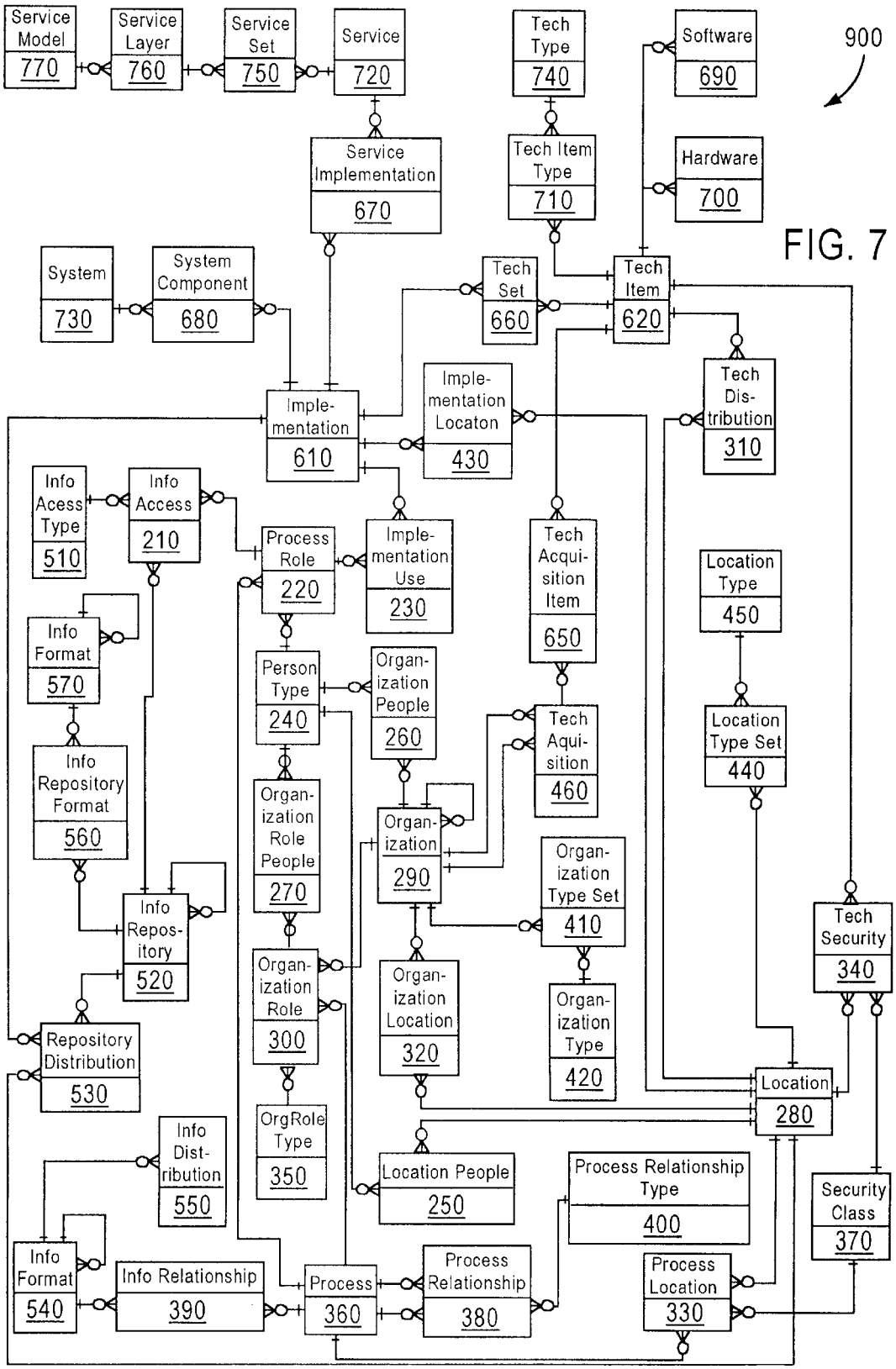
FIG. 7 is a perspective view of the present invention.

Reference is now made to FIG. 7 illustrating an embodiment of the present invention. As depicted in FIG. 7, a power distribution panel 100 receives plugs 102–106 in each of several receptacles 108–112. Power distribution panel 100, described in detail in the Background Art, is of a type including a cover plate system and requiring sequential coupling of plugs as described in U.S. Pat. No. 4,955,821 entitled Method For Controlling Connector Insertion Or Extraction Sequence On Power Distribution Panel to the present inventor. The sequential coupling guard, disclosed in the '821 patent, operates in conjunction with the cover plate system to require insertion of plugs 102–106 into receptacles 108–112 in sequential order and to prevent access to receptacles 108–112 out of sequence. However, the first receptacle 108 of panel 100 is either uncovered or covered only by a nonlocking cover plate leaving receptacle 108 subject to misuse and vandalism. The nonlocking cover plate is more fully described in the Background Art section. Similarly, the last plug 106 is not locked into place in receptacle 112 leaving both plug 106 and receptacle 112 subject to tampering. In addition, because last plug 106 is not locked in place, prior inserted plugs 102–105 are removable in reverse insertion order leaving both plugs 102–105 and receptacles 108–111 subject to tampering.

The present invention improves over the power distribution panel employing a sequential coupling guard with cover plates as disclosed in the '821 patent by reducing the likelihood of access to the unblocked first receptacle 108 prior to plug 102 insertion and reducing the likelihood of access to the last receptacle 112 and plug 106 once all prior plugs 102–105 have been inserted. By reducing access to the last plug 106 and corresponding receptacle 112, access to the prior plugs 102–105 and receptacles 108–111 is also reduced.

The sequential coupling guard, in conjunction with the cover plate system, operates as follows. Inserting and locking in place one plug results in the opening of the cover plate covering the subsequent receptacle and enabling the insertion, rotation and activation of the subsequent plug in the subsequent receptacle. For example, the second receptacle 109 remains covered until first plug 102 is inserted and rotated in first receptacle 108, third receptacle 110 remains covered until second plug 103 is inserted and rotated in second receptacle 109, and so on until fourth plug 105 is inserted and rotated in fourth receptacle 111 causing the opening of the cover plate over fifth and final receptacle 112. Because the first receptacle 108 is either uncovered or covered by a nonlocking cover plate, receptacle 108 is subject to misuse and vandalism prior to plug 102 insertion.

First and subsequent receptacles 108–112 are subject to tampering and vandalism after all plugs have been inserted and rotated because the sequential coupling guard mechanism only specifies the order of insertion and does not lock the last plug 106 into place. Even though the cover plate system prevents incorrect order of plug insertion, the cover plates do not reduce the likelihood of misuse of the first open receptacle 108 when no plugs are inserted, nor do the cover plates reduce the likelihood of misuse of the last and prior plugs 102–106 and receptacles 108–112 when the plugs 102–106 have been inserted and rotated. A locking cover plate 114 is designed to cover the first open receptacle 108 prior to plug 102 insertion. When all plugs 102–106 have been sequentially inserted and rotated, a locking device 116 is used to lock in place the last and prior plugs 102, 106 in corresponding receptacles 108, 112.

Description Of Locking Cover Plate

Figure 8:
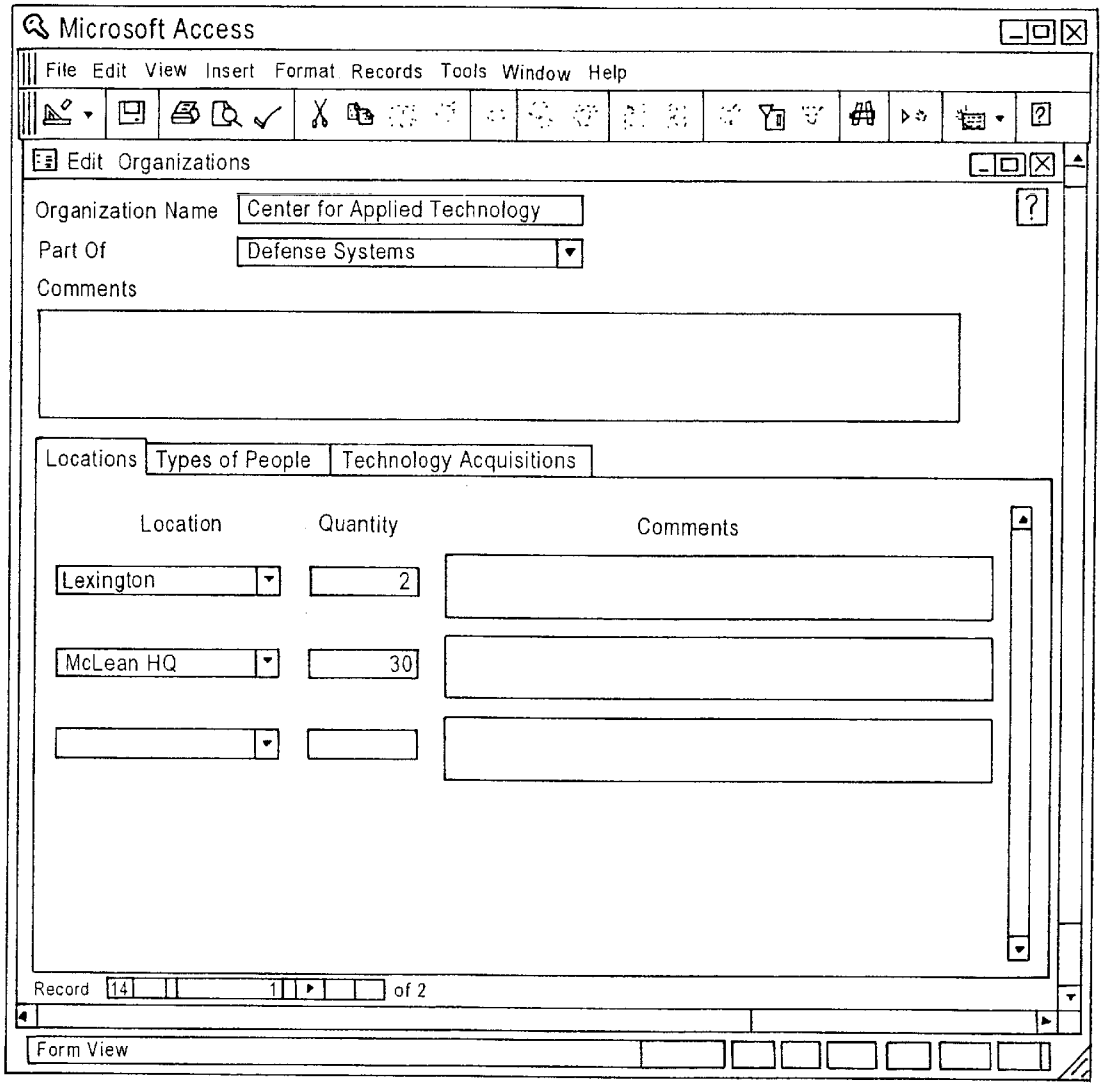
FIG. 8 is a perspective view of a locking cover plate of the present invention.

Locking cover plate 114 is rotatably mounted in front panel 118 of power distribution panel 100 adjacent first receptacle 108. With reference to FIG. 8, locking cover plate 114 includes a lock portion 120 coupled with a cover plate portion 124. Lock portion 120 is a cylindrical locking mechanism as known in the art. Cover plate portion 124 is a circular cover plate for blocking access to receptacle 108 prior to plug 102 being inserted. Key 122 (FIG. 7) fits the lock portion 120 of locking cover plate 114 to enable locking and unlocking of cover plate 114. As key 122 locks and unlocks lock portion 120, cover plate portion 124 coupled to lock portion 120 rotates in the same direction as key 122, respectively, covering and uncovering the opening of receptacle 108. Cover plate portion 124 sweeps through an arc parallel to the plane of front panel 118 and perpendicular to the opening of receptacle 108 to cover and uncover receptacle 108.

When in the locked position, cover plate portion 124 of locking cover plate 114 covers receptacle 108 preventing insertion of plug 102 and precluding access by individuals without key 122. When in the unlocked position, cover plate portion 124 of locking cover plate 114 is rotated out of receptacle 108 permitting insertion of plug 102. Cover plate portion 124 is preferably the same material, color and size as the cover plates covering receptacles 109–112 to reduce manufacturing costs and provide a uniform appearance to users.

Description Of Locking Device

Figure 9:
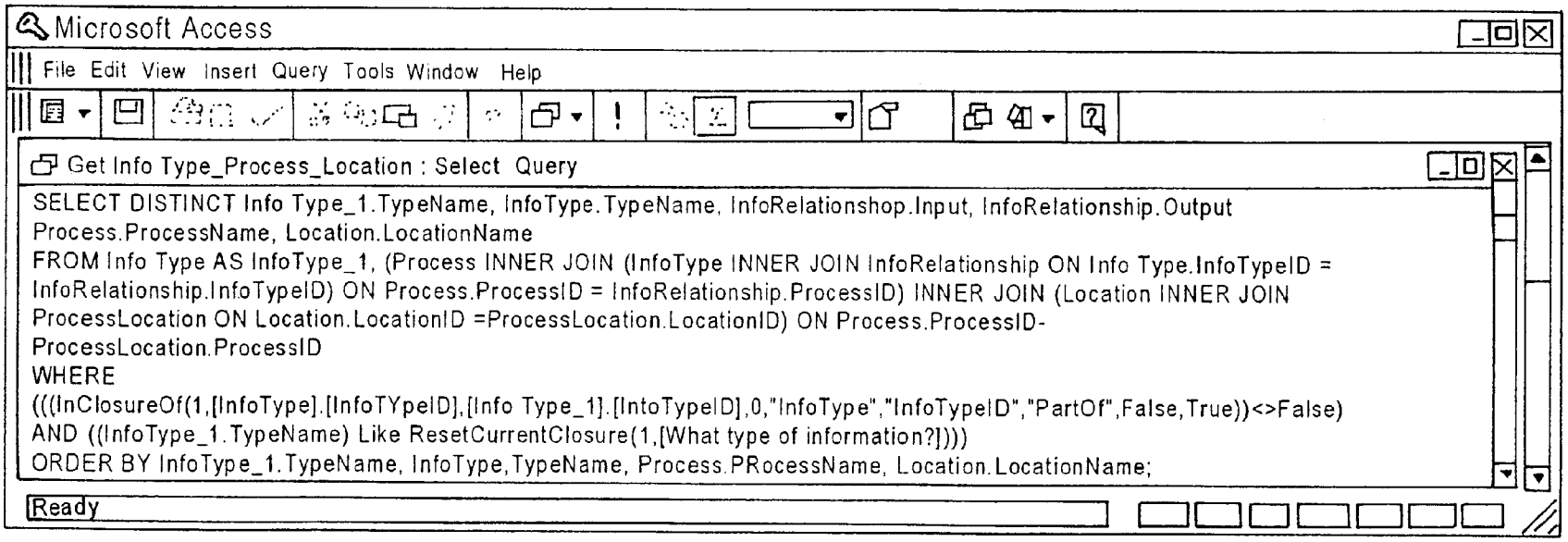
FIG. 9 is a perspective view of a locking device of the present invention.
Figure 5:
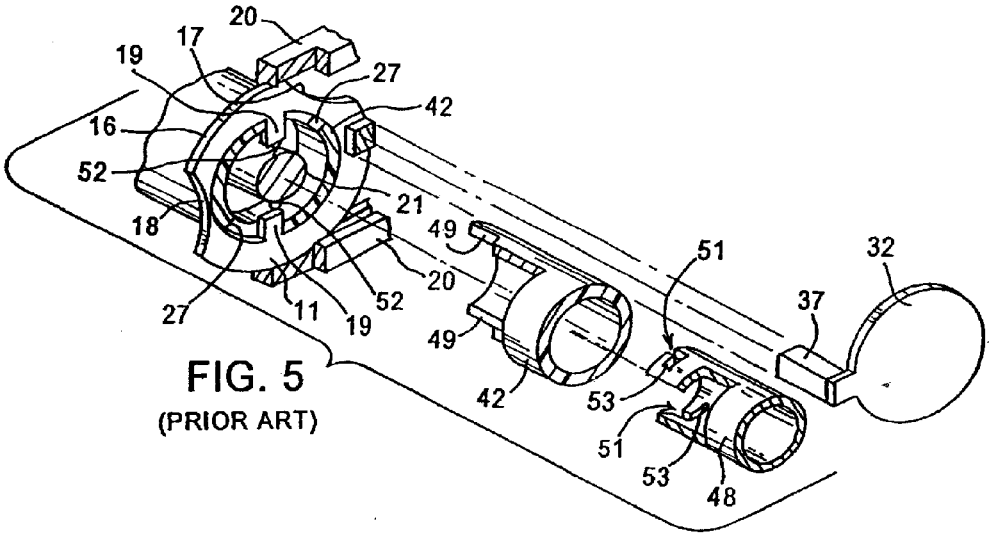
FIG. 5 (PRIOR ART)
Figure 1:
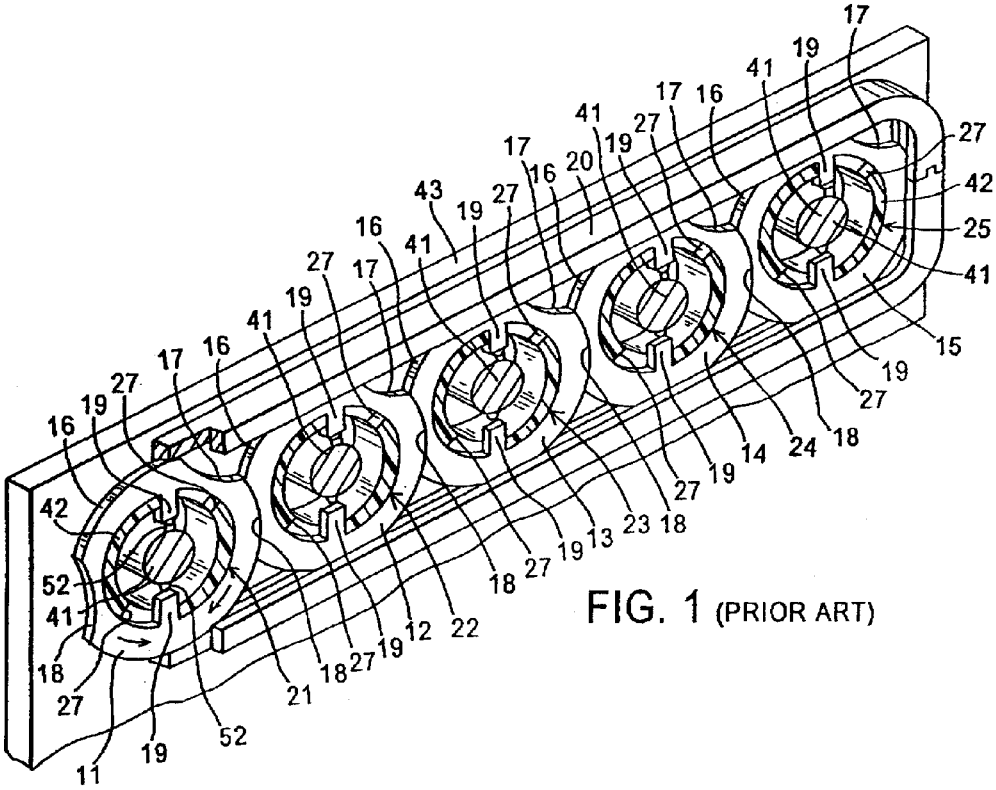
FIG. 1 (PRIOR ART)
Figure 2:
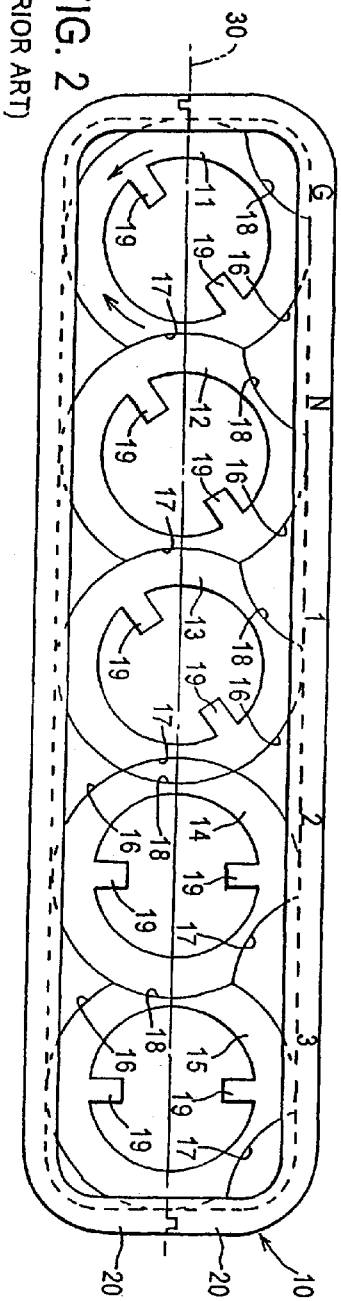
FIG. 2 (PRIOR ART)
Figure 3:
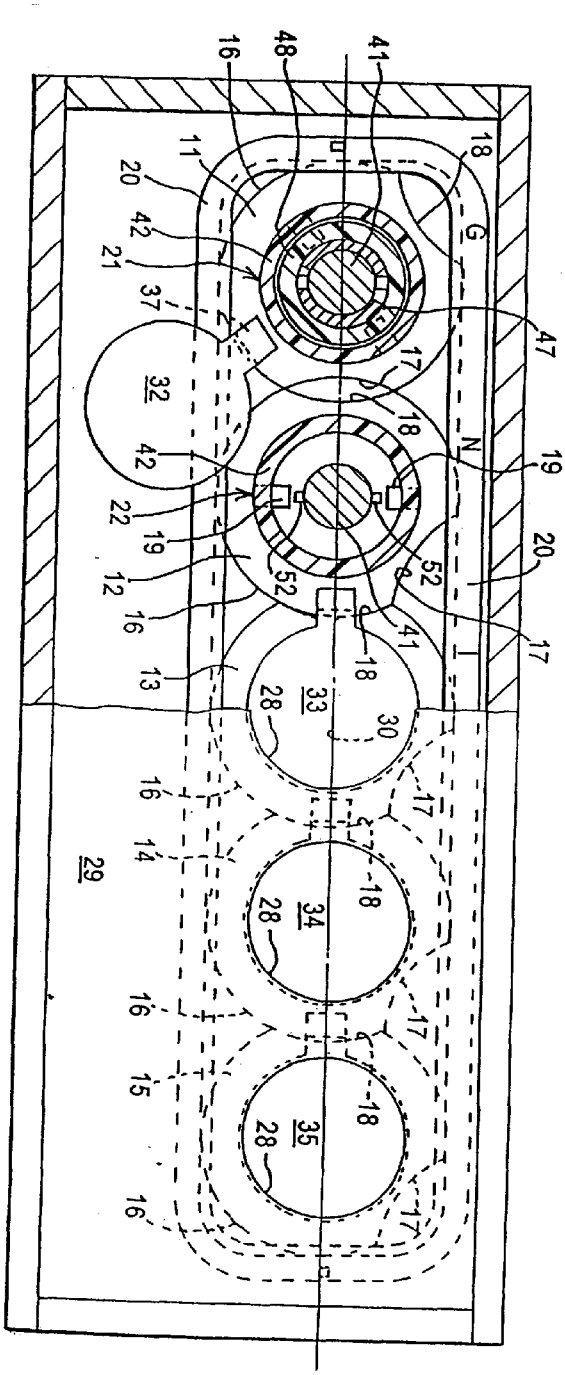
FIG. 3 (PRIOR ART)
Figure 4:
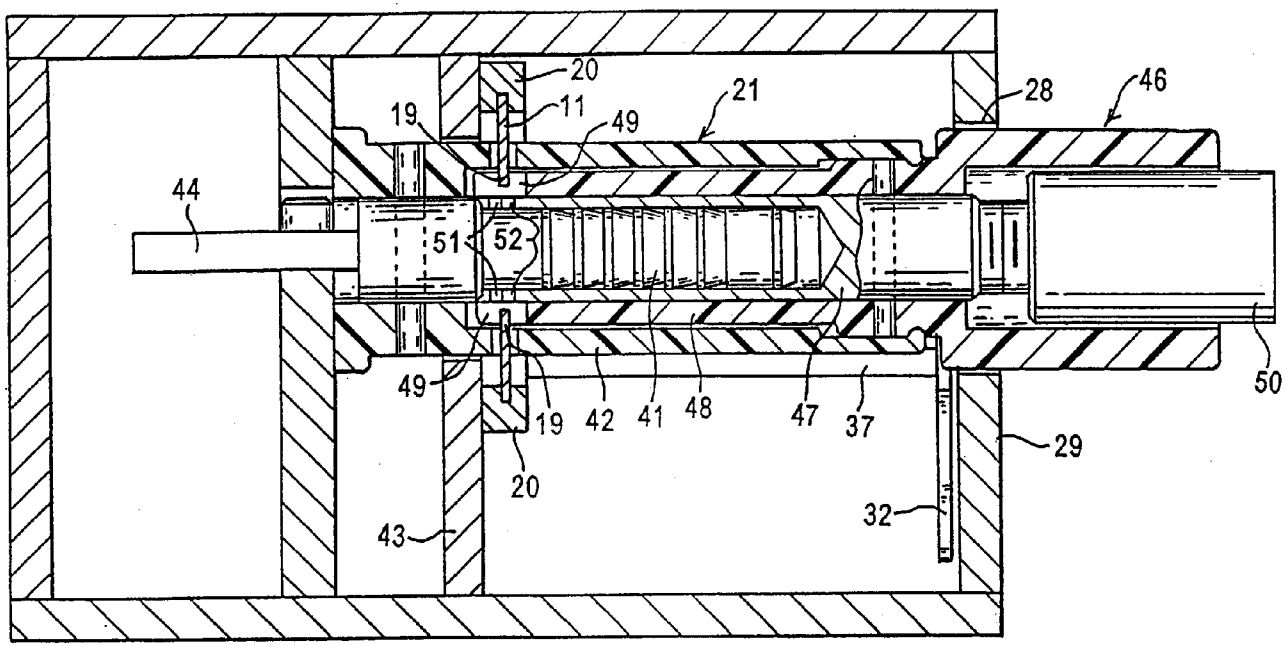
FIG. 4 (PRIOR ART)
Figure 6:
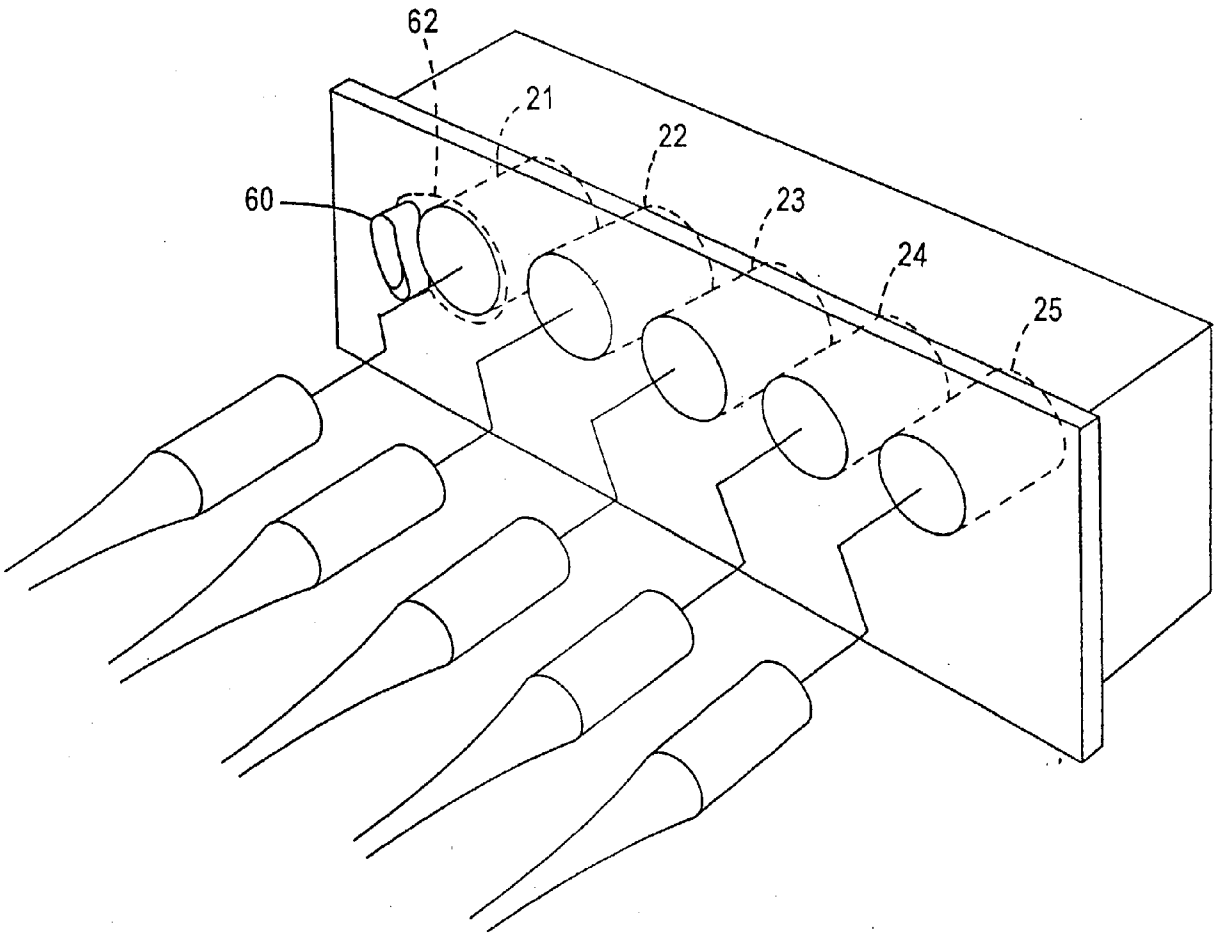
FIG. 6 (PRIOR ART)
Figure 7:
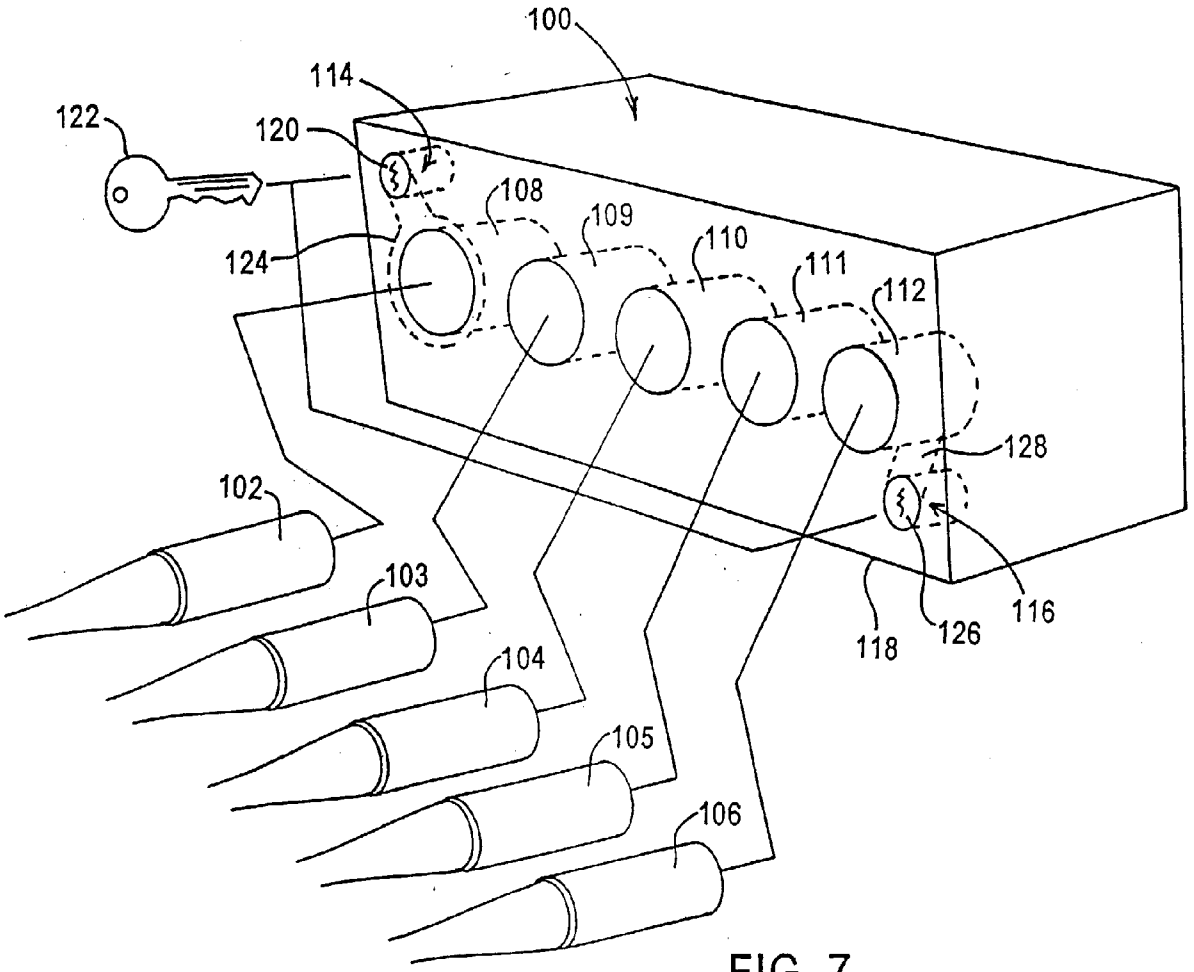

Locking device 116 is rotatably mounted in front panel 118 of power distribution panel 100 adjacent the last receptacle 112. With reference to FIG. 9, locking device 116 includes a lock portion 126 coupled with a tab portion 128. Lock portion 126 is a cylindrical locking mechanism as is known in the art. Tab portion 128 is a rectangular tab with a convex outer edge to fit either the clearance notch or the locking notch on the cam ring of receptacle 112 (FIG. 7) and inhibits rotation of the cam ring when tab portion 128 is in the locked position. By not allowing the cam ring to rotate, plug 106 is locked in place in receptacle 112 (FIG. 7). Tab portion 128 could also be configured to lock plug 106 in receptacle 112 by interfacing with a portion of plug 106 (FIG. 7).

Key 122 fits lock portion 126 of locking device 116 to lock and unlock plug 106 in receptacle 112 respectively inhibiting and enabling removal of plug 106 from receptacle 112. Separate lock and key pairs can be used for locking cover plate 114 and locking device 116 or, as in the embodiment described above, one key 122 can be used to operate both mechanisms.

When plug 106 is inserted and rotated in receptacle 112 and locking device 116 is in the locked position, tab portion 128 of locking device 116 holds plug 106 in place inhibiting removal from receptacle 112. When locking device 116 is in the unlocked position, plug 106 is removable from receptacle 112.

Advantageously, locking cover plate 114 reduces the likelihood of misuse of receptacles of power distribution panels. Additionally, locking device 116 reduces the likelihood of removal of plugs from receptacles of power distribution panels.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A power distribution panel having one or more receptacles for receiving one or more corresponding plugs, comprising:

a locking cover plate assembly mounted within said power distribution panel for controlling insertion of a first of said corresponding plugs into a first of said one or more receptacles wherein said locking cover plate assembly comprises a cover plate and a lock mechanism with the cover plate being coupled to said lock mechanism and rotatable therewith to cover a first of said one or more receptacles and wherein said cover plate rotates in response to said lock mechanism rotation; and a locking device mounted within said power distribution panel for preventing removal of a last of said corresponding plugs from a last of said one or more receptacles.

2. The power distribution panel of claim 1, wherein said power distribution panel further includes a sequential coupling guard for insuring said plurality of plugs are connected to said plurality of receptacles in a predetermined sequence.

3. The power distribution panel of claim 2, wherein said locking device comprises a tab coupled with a lock, said tab is rotatable with said lock to prevent movement of said sequential coupling guard.

4. The power distribution panel of claim 1, wherein said locking device comprises a tab coupled with a lock, said tab is rotatable with said lock to prevent removal of said corresponding plug from said receptacle by engaging said corresponding plug.

5. A power distribution panel having one or more receptacles for receiving one or more plugs, comprising:

a locking cover plate mounted within said power distribution panel for controlling access to a first of said one or more receptacles wherein said locking cover plate assembly comprises a cover plate coupled to a lock and rotatable therewith to cover the first of said one or more receptacles and wherein said cover plate rotates in response to said lock mechanism rotation.

6. The power distribution panel of claim 5, wherein said power distribution panel employs a sequential coupling guard for insuring said plurality of plugs are connected to said plurality of receptacles in a predetermined sequence.

7. A power distribution panel having one or more receptacles for receiving one or more plugs, wherein said power distribution panel employs a sequential coupling guard for insuring said one or more plugs are connected to said one or more receptacles in a predetermined sequence, comprising:

a locking device mounted within said power distribution panel for inhibiting removal of a last of said one or more plugs from a last of said one or more receptacles wherein said locking device comprises a tab coupled with a locking mechanism and rotatable therewith to prevent movement of said sequential coupling guard.

8. A power distribution panel having a first, a last, and intermediate receptacles for receiving one or more corresponding plugs, wherein said power distribution panel employs a sequential coupling guard for insuring said one or more plugs are connected to said one or more receptacles in a predetermined sequence, comprising:

a locking cover plate mounted in said power distribution panel for controlling access to said first receptacle wherein said locking cover plate comprises a cover plate coupled to a lock mechanism and rotatable therewith to cover one of said one or more receptacles and wherein said cover plate rotates in response to said lock mechanism rotation; and a locking device mounted in said power distribution panel for inhibiting removal of a last plug of said one or more plugs from said last receptacle.

9. A method of locking a power distribution panel having one or more receptacles for one or more plugs, wherein a first receptacle is vulnerable to misuse prior to a connection being made between a plug and a receptacle and a last receptacle is subject to misuse and/or improper removal after said connection is made, wherein a locking cover plate is mounted to said panel for controlling access to said first receptacle when locked and a locking device is mounted to said panel for inhibiting removal of said last plug from said last receptacle when locked, wherein said locking cover plate comprises a cover plate coupled to a lock mechanism and rotatable therewith to cover one of said one or more receptacles and wherein said cover plate rotates in response to said lock mechanism rotation, wherein said locking device comprises a tab coupled with a lock and rotatable therewith to inhibit removal of one of said one or more plugs, wherein said power distribution panel employs a sequential coupling guard for insuring said one or more plugs are connected to said one or more receptacles in a predetermined sequence, the method comprising the steps of:

unlocking said locking cover plate covering said first receptacle;

sequentially inserting said plugs causing opening of subsequent receptacle cover plates;

inserting said last plug in said last receptacle; and locking said locking device retaining said last plug in said last receptacle.

* * * * *

UNITED STATES PATENT AND TRADEMARK OFFICE

CERTIFICATE OF CORRECTION

PATENT NO. : 6,413,104 B1
DATED : July 2, 2002
INVENTOR(S) : Allen J. Bernardini It is certified that error appears in the above-identified patent and that said Letters Patent is hereby corrected as shown below:

The title page should be deleted to appear as per attached title page.

The sheets of drawings consisting of figures 1-9 should be deleted to appear as per figures 1-7.

Signed and Sealed this

Eleventh Day of February, 2003

JAMES E. ROGAN
*Director of the United States Patent and Trademark Office*

(12) United States Patent
Bernardini

(10) Patent No.: US 6,413,104 B1
(45) Date of Patent: Jul. 2, 2002

(54) POWER DISTRIBUTION PANEL WITH SEQUENCE CONTROL AND ENHANCED LOCKOUT CAPABILITY

(75) Inventor: Allen J. Bernardini, Southbury, CT (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/492,817

(22) Filed: Jan. 28, 2000

(51) Int. Cl.[7] ..... H01R 13/44

(52) U.S. Cl. ..... 439/133; 439/924.2; 439/304; 70/57

(58) Field of Search ..... 439/133, 142, 439/299, 924.1, 924.2, 345, 347, 304; 70/57, 58, 163, 166, 170, 179

(56) References Cited

U.S. PATENT DOCUMENTS

| | | | | |
|---|---|---|---|---|
| 3,994,148 A | * | 11/1976 | Anderson | |
| 4,034,172 A | * | 7/1977 | Glover et al. | |
| 4,080,029 A | * | 3/1978 | St. Fort | |
| 4,093,331 A | * | 6/1978 | Molchan | |
| 4,146,682 A | * | 3/1979 | Nakao | 429/97 |
| 4,740,168 A | * | 4/1988 | Carney et al. | 439/133 |
| 4,941,841 A | * | 7/1990 | Darden | 439/374 |
| 4,955,821 A | | 9/1990 | Bernardini | 439/133 |
| 5,113,311 A | * | 5/1992 | Kamp et al. | 439/133 |
| 5,429,522 A | * | 7/1995 | Noschese et al. | 439/133 |
| 5,488,208 A | * | 1/1996 | Seewald | 439/133 |
| 5,934,918 A | * | 8/1999 | Wuechner | 439/133 |

OTHER PUBLICATIONS

Litton/VEAM, "Electrical Power Distribution Solutions", Litton Systems, Inc., 1997, pp. 1–11.

* cited by examiner

*Primary Examiner*—Neil Abrams
(74) *Attorney, Agent, or Firm*—Lowe Hauptman Gilman & Berner, LLP

(57) ABSTRACT

A locking cover plate and locking device respectively, control access to a receptacle and inhibit removal of a plug from a receptacle of a power distribution panel having a sequential coupling guard at a row of receptacles. The first locking cover plate rotates to lock and unlock a receptacle by covering the receptacle using a cover plate portion and uncovering the cover plate portion from the receptacle, respectively. The locking device rotates to lock and unlock a plug in the last receptacle by inhibiting removal of the plug from the receptacle using a tab portion and allowing removal of the plug by rotating the tab portion, respectively.

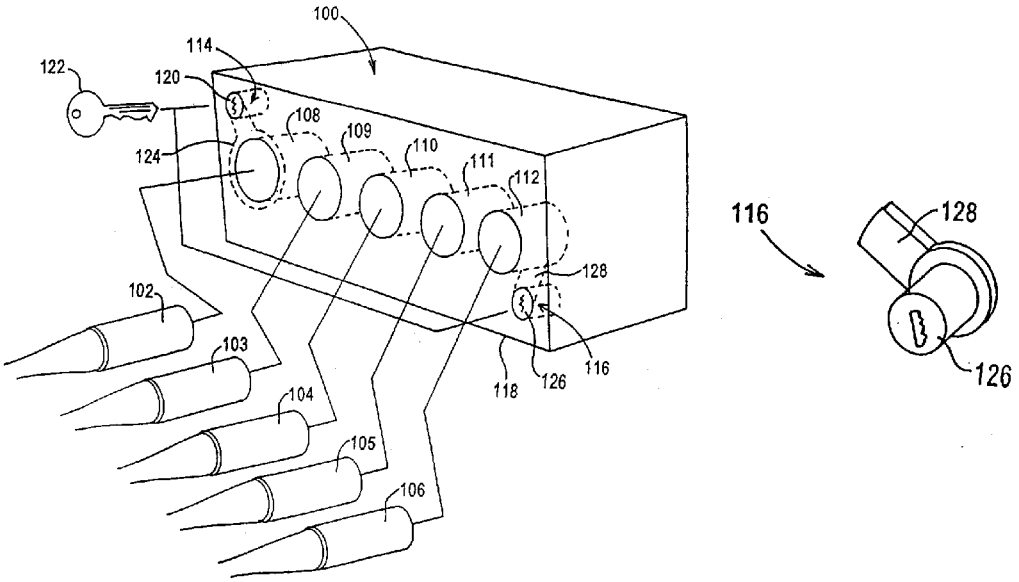

9 Claims, 9 Drawing Sheets